US005420612A

United States Patent [19]

Brock et al.

[11] Patent Number: 5,420,612

[45] Date of Patent: May 30, 1995

[54] PRINT HEAD WITH ELECTRODE TEMPERATURE CONTROL FOR RESISTIVE RIBBON THERMAL TRANSFER PRINTING

[75] Inventors: George W. Brock, La Jolla; Jeremiah F. Connolly, San Diego, both of Calif.

[73] Assignee: Eastman Kodak Company, Rochester, N.Y.

[21] Appl. No.: 86,742

[22] Filed: Jul. 1, 1993

[51] Int. Cl.[6] ..... B41J 2/395

[52] U.S. Cl. ..... 347/201

[58] Field of Search ..... 340/76 PH, 139 C, 155; 400/120

[56] References Cited

U.S. PATENT DOCUMENTS

| | | | |
|---|---|---|---|
| 3,553,424 | 1/1971 | Spaulding | 219/388 |
| 3,862,394 | 1/1975 | Lane, III | 219/216 |
| 4,170,728 | 10/1979 | Flasck | 219/216 |
| 4,194,108 | 3/1980 | Nakajima et al. | 219/216 |
| 4,350,449 | 9/1982 | Countryman et al. | 400/120 |
| 4,484,200 | 11/1984 | Tabata et al. | 346/76 PH |
| 4,684,960 | 8/1987 | Nishiwaki et al. | 346/76 PH |
| 4,689,639 | 8/1987 | Kimura et al. | 346/76 PH |
| 4,691,210 | 9/1987 | Nishiguchi et al. | 346/76 PH |
| 4,703,331 | 10/1987 | Stevens, Jr. | 346/140 R |
| 5,317,343 | 5/1994 | Brock et al. | 346/76 PH |

FOREIGN PATENT DOCUMENTS

| | | | |
|---|---|---|---|
| 62-99162 | 5/1987 | Japan | H01M 2/04 |
| 0188067 | 8/1988 | Japan | 346/76 PH |

OTHER PUBLICATIONS

IBM Technical Disclosure Bulletin, vol. 26, No. 10A, Mar. 1984, Fathergill et al., Flexible Electrode Printhead with Heat Sink.

*Primary Examiner*—Huan H. Tran
*Attorney, Agent, or Firm*—Milton S. Sales

[57] ABSTRACT

A print head applies electrical energy to an electrically resistive and grounded transfer ribbon bearing heat transferable dye, during sliding pressure contact and relative movement between the head and ribbon, for resistive heating of the dye for transfer to a receiver to form images thereon. The head has a row of electrodes, an electrically non-conductive substrate and an electrically non-conductive and thermally insulating barrier layer in abutment, with the barrier layer between the electrodes and substrate. The barrier layer has a thermal conductivity at most about one-tenth of that of the substrate and a thickness sufficient to retard heat transfer from the electrodes to the substrate for controlling the temperature of the electrodes.

14 Claims, 6 Drawing Sheets

PRINT HEAD WITH ELECTRODE TEMPERATURE CONTROL FOR RESISTIVE RIBBON THERMAL TRANSFER PRINTING

CROSS-REFERENCE TO RELATED PATENT APPLICATIONS

This Patent Application is related to:

(1) U.S. patent application Ser. No. 08/086,777 (KOD 65,470—George W. Brock, Jeremiah F. Connolly and Kent R. Gandola), which is being filed simultaneously herewith and has a common assignee and two common inventors with this patent application, and which is entitled "PRINT HEAD WITH PIXEL SIZE CONTROL FOR RESISTIVE RIBBON THERMAL TRANSFER PRINTING;" and (2) U.S. patent application Ser. No. 08/086,496 (KOD 66,276—George W. Brock), which is being filed simultaneously herewith and has a common assignee and one common inventor with this patent application, and which is entitled "SELF-FUSING IMAGE PRODUCING PRINT HEAD FOR RESISTIVE RIBBON THERMAL TRANSFER PRINTING."

FIELD OF THE INVENTION

This invention relates to a print head with electrode temperature control for resistive ribbon thermal transfer printing.

BACKGROUND OF THE INVENTION

Various printing systems are known for recording (printing) character (text) or graphic (picture) images on a recording medium (receiver) such as a paper or polymer sheet. Examples thereof are set forth in the following prior art.

U.S. Pat. No. 3,553,424 (Spaulding), issued Jan. 5, 1971, discloses heat stabilizing (fixing) of latent images on spectrally sensitized, i.e., photographic emulsion, printout paper, by passing the paper along a multi-zone heating surface segregated by groove and stepped portions for progressive heating, followed by cooling.

U.S. Pat. No. 4,703,331 (Stevens, Jr.), issued Oct. 27, 1987, discloses a spark jet printer with a plurality of spark jet units, each having a spring-fed consumable, solid ink electrode with an end adjacent the end of a fixed counter electrode energized for issuing an ink spark jet to form images on paper.

U.S. Pat. No. 3,862,394 (Lane, III), issued Jan. 21, 1975, discloses a thermal print head with a trifluoro methylene coated, triangular shaped aluminum substrate having an apex forming a print edge across which electrically insulated copper plated wires extend. The insulation and copper plate are removed from the wires at the apex to form resistance heaters thereat.

U.S. Pat. No. 4,689,639 (Kimura etal.), issued Aug. 25, 1987, discloses a thermal print head with heating elements in a groove or on an edge portion thereof to heat an ink film (donor web) for ink transfer to paper to form images thereon.

U.S. Pat. No. 4,691,210 (Nishiguchi etal.), issued Sep. 1, 1987, discloses a thermal print head for heat sensitive recording, with heating elements separated from an alumina ceramic substrate by a glaze layer, mainly of silica, about 35 to 50 microns (0.0014 to 0.002 inch) thick. The elements have an inner heat generating resistor layer of tantalum nitride or titanium oxide (TiO), and an outer layer of pairs of aluminum or gold conductor electrodes. The elements are overcoated by a protecting layer of tantalum pentoxide. The type of thermal recording effected with the print head is not indicated.

U.S. Pat. No. 4,194,108 (Nakajima et al.), issued Mar. 18, 1980, discloses a thermal print head with groove separated resistance heaters for forming images in thermally sensitive paper at 500 degrees C. under a 200 gram per sq. cm. (2.8 psi) force.

U.S. Pat. No. 4,170,728 (Flasck), issued Oct. 9, 1979, discloses a thermal print head having an apex edge with non-conductive cement coated, side by side bent wire threads forming resistance heaters protruding from side by side notches in a metal heat sink support body coated with an anodized oxide insulating layer. The apex edge is encapsulated in an insulating potting material acting as a heat sink. The protruding threads contact and heat a heat responsive recording sheet to form images therein.

U.S. Pat. No. 4,350,449 (Countryman et al.), issued Sep. 21, 1982, discloses a resistive ribbon thermal transfer print head with a row of side by side, spaced apart, electrodes for sliding pressure contact with a fusible (meltable) ink bearing resistive ribbon overlying conventional paper on a platen. Electrothermic printing of images is effected by transfer of melted ink from the ribbon to the paper under high print head force during movement of the head relative to the ribbon and paper. The electrodes, which are of unidentified material, are embedded in a thin insulating layer between plates of unidentified material, and have exposed, ribbon contacting electrode ends. The ribbon has an upper, print head contacting resistive layer, an intermediate conductive ground layer of aluminum with a thin insulating layer of aluminum oxide, and a lower ink layer. Electrode energizing resistively heats discrete ribbon areas to release ink for transfer to the paper. The ground layer provides a short current path from the electrodes through the resistive layer for localized heating of contiguous ink portions in the ink layer, with current return from the ground layer to ground via an element remote from the electrodes. For imaging thermally sensitive paper, the ink layer is omitted from the ribbon.

IBM Technical Disclosure Bulletin, Vol. 26, No. 10A, March 1984 (Fathergill et al.), discloses a flexible electrode, multi-layer print head used for resistance ribbon printing to generate high temperatures near the print electrode tips which follow the ribbon closely during printing. As the heat is produced in the ribbon, high temperatures in the head are not required. The head has a first compliant layer of silicone rubber supporting a second heat sink layer of vacuum deposited copper or aluminum, coated by a third heat resistant resin layer, carrying a fourth thermally conductive adhesive layer for adhering thereto a fifth tungsten electrode layer which is overcoated by a sixth heat resistant resin top layer. The second heat sink layer protects the head from injury from heat while not adding undue rigidity thereto.

U.S. Pat. No. 4,484,200 (Tabata et al.), issued Nov. 20, 1984, discloses a recording head with an electrically insulating, epoxy resin support containing a row of side by side, spaced apart, recording electrodes and a common opposed return electrode. The head contacts a moving ribbon bearing electroconductive heat transferable, wax based ink for transfer to paper by Joule heat generated in the ribbon by image delineating current applied by selected recording electrodes, with current return via the return electrode. The resin support of the head has a contact surface at which the adjacent ends of the electrodes contact the ribbon. A transverse groove in the contact surface between the recording electrode ends and the return electrode end prevents ink from adhering to the head during printing. An exemplified ribbon has a carbon black loaded polyvinyl butyral resin base layer coated with a carbon black containing wax of 60 degrees C. melting point.

Japanese Patent Laid-Open No. 99,162/87 (Mormose), dated May 8, 1987 (per English translation), discloses a four layer recording head that contacts the resistance layer of a heat transfer sheet (ribbon) having a fusible ink layer, for passing current to fuse the ink for thermoelectric transfer to a recording sheet as image forming dots. The head has a first substrate layer of mica ceramics supporting a second layer of a row of side by side, spaced apart, recording electrodes, e.g., tungsten wires, of 250 micron (0.01 inch) pitch (center to center electrode distance). The recording electrodes may be secured to the first layer by an adhesive, e.g., silicon dioxide. A third spacer layer of heat resisting resin, e.g., polyimide, of thickness close to the recording electrode pitch, e.g., a thickness of 150 microns (0.006 inch), separates the second layer of recording electrodes from a fourth common return electrode layer. The distance between the recording electrodes and return electrode, which determines the occurrence of cross talk and unequal size printed image dots, depends on the third spacer layer thickness accuracy, rendering irrelevant the first substrate layer thickness accuracy.

U.S. Pat. No. 4,684,960 (Nishiwaki), issued Aug. 4, 1987, discloses a print head with a row of side by side, spaced apart, alternating polarity, recording electrodes, e.g., of positive polarity, and return electrodes, e.g., of negative polarity, such as tungsten, molybdenum and/or manganese electrodes, i.e., metal electrodes of relatively low hardness, of 10 to 30 micron (0.0004 to 0.0012 inch) thickness, supported on a common ceramic substrate of alumina, forsterite, etc., such as of 0.5 to 3 mm (500 to 3,000 micron; 0.02 to 0.12 inch) thickness. The electrodes and substrate have end faces in a contact plane for sliding contact with an electrothermal ink bearing transfer film (resistive ribbon) overlying paper on the resilient surface of a platen, e.g., under a low contact pressure of 1.2 to 2.2 kg per sq. cm. (17 to 31 psi), for heat transfer of wax based ink from the resistive ribbon to the paper to form images thereon. The ribbon may have an electrically conductive (resistive) first contact layer of a carbon powder containing resin, an optional supporting second layer of polyethylene terephthalate, and a third ink layer of wax and a pigment or dye that is fusible at 60 degrees C. The contact plane of the electrode and substrate ends is at an acute angle to the plane of the substrate supported row of electrodes.

A second embodiment has a ribbon with a first contact layer of high electrical resistance, a second metal or carbon layer of low electrical resistance, an optional third tensile layer, and a fourth (wax based) ink layer. The print head has recording electrodes perpendicular to the ribbon, and return electrode spikes remote from the print head to pierce the ribbon for conductive contact with the second layer to complete the circuit. A third embodiment has a print head with a row of recording electrodes and an opposed common return electrode akin to Tabata et al. discussed above.

It is noted that a resistive ribbon thermal transfer print head has electrodes that supply current to a resistive ribbon to generate heat in the ribbon to heat the dye therein. On the other hand, a thermal print head has resistors that generate heat in the head for transfer to a donor web to heat the dye therein.

In resistive ribbon thermal printing, heat is generated in an electrically resistive ribbon bearing thermally transferable dye when current flows through the resistive layer and ground layer (return electrode) materials of the ribbon. This is commonly referred to as Joule heating. Current is supplied to the ribbon by a linear array of discrete, electrically conductive electrodes in the print head, i.e., a row of side by side, spaced apart, electrodes mechanically supported by a substrate. Modulated current is fed to the electrodes as current pulses via conductors.

The resistive ribbon typically has an upper base layer of electrically resistive polymer for contacting the electrodes, an intermediate electrically resistive ground layer of conductive material, e.g., aluminum, on which an electrically resistive oxide layer, e.g., aluminum oxide, forms (grows), and a lower layer of dye heatable to a transfer temperature for transfer to a receiver.

There are three primary resistances in the ribbon current flow path. The first is the "contact" resistance at the contact interface between the electrodes and ribbon. The second is the "bulk" resistance at the bulk (mass) of the base layer resistive polymer. The third is the "interface" resistance at the interface of the conductive ground layer, e.g., aluminum, and its resistive oxide layer. The heat generated at each of these resistances contributes to the transfer of dye from the ribbon to the receiver.

A high force is required at the contact interface of the print head and ribbon for good compliance therebetween. This force, plus the high temperature that can occur in printing, unless controlled, can damage the ribbon and limit the electrical energy supplied thereto by the electrodes, making the operation energy inefficient.

Image quality is affected by the temperature profile in the dye mass being transferred. This profile is adversely influenced by the significant energy lost by heat transfer from the ribbon to the electrodes which heats the electrodes. This heat is conducted away from the electrodes by the substrate at a rate determined by the thermal conductivity of the substrate, typically a ceramic material such as steatite, alumina or magnesia.

A low thermal conductivity substrate, typically of 2 to 20 W/m.C (watts per meter per degree C.), such as steatite or alumina (95.0% purity) is normally used. This limits the operation to slow printing speeds and character (text) image production. If operated at faster printing speeds or for producing near-photographic (picture) images, dye trails (bleeding) and ribbon damage can occur due to slow electrode cool down.

Use of a substrate of high thermal conductivity, typically of 20 to 80 W/m.C., or higher, such as alumina (at least 99% purity) or magnesia, rapidly conducts heat away from the electrodes for fast electrode cool down, but can deprive the dye in the ribbon of the heat needed to transfer a proper dye amount to the receiver, particularly if the substrate has an exposed end face (contact face) in sliding contact with the resistive ribbon.

It is desirable to provide a print head having electrodes supported by a substrate for resistive ribbon thermal transfer printing, with means to control the electrode temperature.

SUMMARY OF THE INVENTION

The drawbacks of the prior art are obviated in accordance with the present invention by providing a print head having electrodes supported by a substrate for resistive ribbon thermal transfer printing, with a thermal barrier to control the electrode temperature and cool down, generally independently of the substrate thermal conductivity.

Specifically, a resistive ribbon thermal transfer print head construction is provided which spaces the electrodes from the supporting substrate by a barrier (spacing) layer of low thermal conductivity material, the thickness of which controls the temperature of the electrodes.

A relatively thick barrier layer retards heat flux (flow) from the electrodes to the supporting substrate, thereby keeping the electrode temperature high, reducing heat loss from the resistive ribbon to the electrodes, and resulting in high energy efficiency of the printing system. Reducing the thickness of the barrier layer allows a more rapid cool down of the electrodes after current pulsing, i.e., after cessation of the energizing current pulses delivered to given electrodes to effect printing, whereby the bulk of the print head on the other side of the barrier layer (including the substrate and other parts remote from the electrodes) rapidly conducts the heat away from the head.

A sharper image is obtained on the receiver with a reduced thickness barrier layer since it leads to faster electrode cooling, whereas slower cooling electrodes, traceable to a thicker barrier layer, cause continuous dye transfer from the heated ribbon after current pulsing ceases. As this slower cooling can lead to bleeding of the dye (dye trails) in the image on the receiver, a maximum barrier layer thickness is selected that achieves a desired level of slower cooling for high operating efficiency without dye bleeding, under Otherwise equivalent conditions. On the other hand, cooler operating electrodes cause more heat to be transferred from the ribbon to the electrodes, reducing operating efficiency.

The barrier layer thickness is thus selectable to provide a choice between higher energy efficiency and less sharp images at higher barrier layer thicknesses, and lower energy efficiency and sharper images at lower barrier layer thicknesses, as desired.

A print head is thus contemplated for selectively applying electrical energy to a contact surface of an electrically resistive and grounded transfer ribbon bearing heat transferable dye, during sliding pressure contact and relative movement between the print head and ribbon in a movement direction, for selective resistive heating of the dye for transfer to a receiver underlying the ribbon remote from the ribbon contact surface and print head to form images on the receiver, under electrode temperature control.

The print head comprises a row of side by side, spaced apart, selectively electrically energizable electrodes comprising electrically conductive, high hardness non-oxide ceramic material, e.g., refractory (heat-resistant) material, especially having a Vickers hardness of at least about 1,500 (Hv). The print head further comprises an electrically non-conductive substrate having a selective thermal conductivity comprising electrically non-conductive, and desirably high hardness, ceramic material, e.g., refractory material, especially having a Vickers hardness of at least about 500 (Hv), and an electrically non-conductive and thermally insulating barrier layer comprising electrically non-conductive ceramic material, e.g., refractory depositable material, having a low thermal conductivity. The barrier layer is interposed between the row of electrodes and the substrate.

The row of electrodes lies in an electrode plane that extends crosswise of the movement direction, the electrodes terminating in a corresponding row of exposed electrode end faces. The row of electrodes in the electrode plane, the barrier layer and the substrate are in abutment, with the barrier layer interposed between the row of electrodes and the substrate for thermally separating the electrodes from the substrate. The row of electrode end faces lies in a contact plane for sliding pressure contact with the resistive ribbon contact surface to apply electrical energy from the electrodes to the ribbon to heat the dye to a transfer temperature.

In particular, the row of electrodes in the electrode plane, the barrier layer and the substrate are in abutment in succession in the movement direction and the print head comprises a print head end portion adjacent the resistive ribbon. Typically, the substrate terminates in a recessed (remote) substrate end face and the barrier layer terminates in a recessed (remote) barrier layer end face, such that the electrode end faces, substrate end face, barrier layer end face and contact plane are located at the print head end portion, with the substrate end face and barrier layer end face arranged as non-contact end faces in spaced relation to the contact plane and remote from the electrode end faces and ribbon.

The substrate has a selective thermal conductivity, e.g., of at least about 2 W/m.C. (watts per meter per degree C.), such as about 2 to 260 W/m.C., or higher, and the barrier layer has a thermal conductivity at most about one-tenth of that of the substrate, e.g., in the range of about 0.2 to 6 W/m.C., and a selective thickness, e.g., of about 1 to 50 microns (about 0.00004 to 0.002 inch), sufficient to retard heat transfer from the electrodes to the substrate to control the electrode temperature.

The electrodes may comprise electrically conductive non-oxide ceramic material such as a carbide ceramic or nitride ceramic material, e.g., a metal carbide, metal nitride or non-metal carbide, and in particular tungsten carbide, silicon carbide, zirconium carbide, titanium carbide, titanium nitride, and the like, of at least about 1,500, Vickers hardness. For optimum electric current conduction from the electrodes to the resistive ribbon, the electrode material is chosen to have a high wear resistance to minimize electrode recession (wear) below the contact face plane of the print head, i.e., the contact plane in which the electrode end faces are normally disposed for sliding pressure contact with the resistive ribbon. Metal electrodes are not contemplated as they possess insufficient hardness, e.g., Vickers hardness, and wear resistance, metals being relatively soft and subject to accelerated wear under the extant operating conditions.

The substrate may comprise electrically non-conductive ceramic material such as an oxide ceramic, nitride ceramic or glass-ceramic material, e.g., metal oxide (including mixed metal oxide), metal nitride, mixed metal oxide and non-metal oxide, or glass-ceramic, and in particular beryllium oxide, aluminum nitride, magnesia (magnesium oxide), alumina (aluminum oxide), magnesium aluminate, titania (titanium oxide), barium titanate, calcium titanate, zirconia (zirconium oxide), forsterite, steatite, fotoceram, pyroceram, and the. like, of at least about 500 Vickers hardness.

Fotoceram (product of Dow Corning Co., N.Y.) is a conventional ceramic material (glass-ceramic) initially having the form and attributes (properties) of glass, which can be molded like glass, but which upon exposure to light irradiation and heat treatment crystallizes to a ceramic substance, such that any areas thereof which are not exposed to light irradiation (masked areas) can be etched away to provide a selectively shaped glass-ceramic composite (structure).

Pyroceram is a conventional ceramic material (glass-ceramic) having the properties of both a glass and a ceramic substance.

The barrier layer may comprise electrically non-conductive and thermally insulating material such as an oxide ceramic material, e.g., a non-metal oxide, metal oxide, or mixed metal oxide and non-metal oxide (e.g., glass), and in particular silicon dioxide, zirconia, refractory glass, and like low thermal conductivity materials that can be deposited, e.g., vacuum deposited or sputtered or ion beam deposited, to controlled thin film dimensions such as of at most about 50 microns thickness, as appropriate.

As used herein, the term "ceramic material" connotes a hard (high hardness) refractory (heat-resistant) material, e.g., (i) formed of a metal carbide, metal nitride or non-metal carbide (i.e., a non-oxide ceramic) having electrical conductivity and thermal conductivity in the case of the electrodes herein, or (ii) formed of a metal oxide (including mixed metal oxide such as magnesium aluminate and barium titanate), metal nitride, mixed metal oxide and non-metal oxide (e.g., forsterite and steatite), or glass-ceramic (e.g., fotoceram and pyroceram), having electrical resistivity (electrical non-conductivity) and selective thermal conductivity in the case of the substrate herein, or (iii) formed of a non-metal oxide, metal oxide (including mixed metal oxide and non-metal oxide such as barium titanate), or mixed metal oxide and non-metal oxide (e.g., glass), having electrical resistivity (electrical non-conductivity) and high thermal resistivity (high thermal insulation properties) in the case of the barrier layer herein.

Also, as used herein, the term "refractory glass" connotes a heat-resistant glass having a high softening or melting point, exceeding the dye transfer temperature, e.g., a softening or melting point above about 600 degrees C.

The print head may further comprise a heat sink element connected to the substrate remote from the barrier layer and electrodes. The contact plane containing the end faces of the electrodes generally extends at an acute angle to the electrode plane. The recessed barrier layer end face and substrate end face generally extend as non-contact faces at the print head end portion in a print head recessed end plane at an obtuse angle to the contact plane of the electrodes and normal to the electrode plane.

This invention also contemplates the combination of the above described print head with an electrically resistive dye transfer ribbon comprising an upper electrically resistive base layer, an intermediate electrically resistive ground layer, and a lower heat transferable dye bearing layer. The dye layer comprises dye heatable to a transfer temperature for transfer to the receiver. The base layer defines the ribbon contact surface which contacts the end faces of the electrodes. The base layer and ground layer serve to convert electrical energy applied by the electrodes to the ribbon to resistance heat for heating the dye in the dye bearing layer.

The invention will be more readily understood from the following detailed description taken with the accompanying drawings and claims.

It is noted that the drawings are not to scale, some portions being shown exaggerated to make the drawings easier to understand.

DETAILED DESCRIPTION

Figure 1:
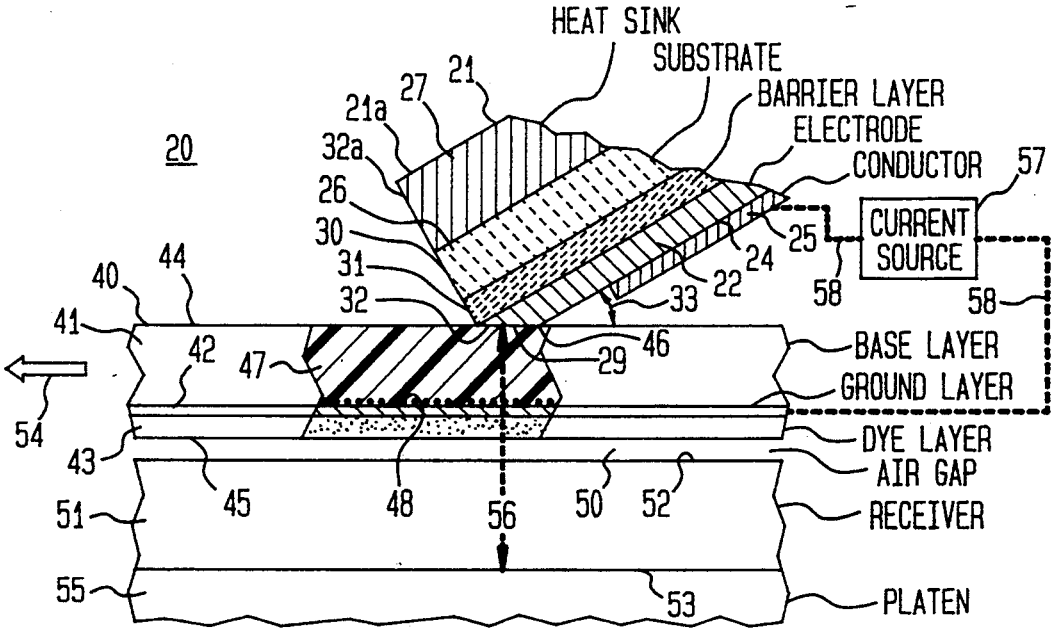
FIG. 1 is a schematic partial sectional side view of an arrangement of a print head and resistive ribbon in accordance with an embodiment of the invention.
Figure 2:
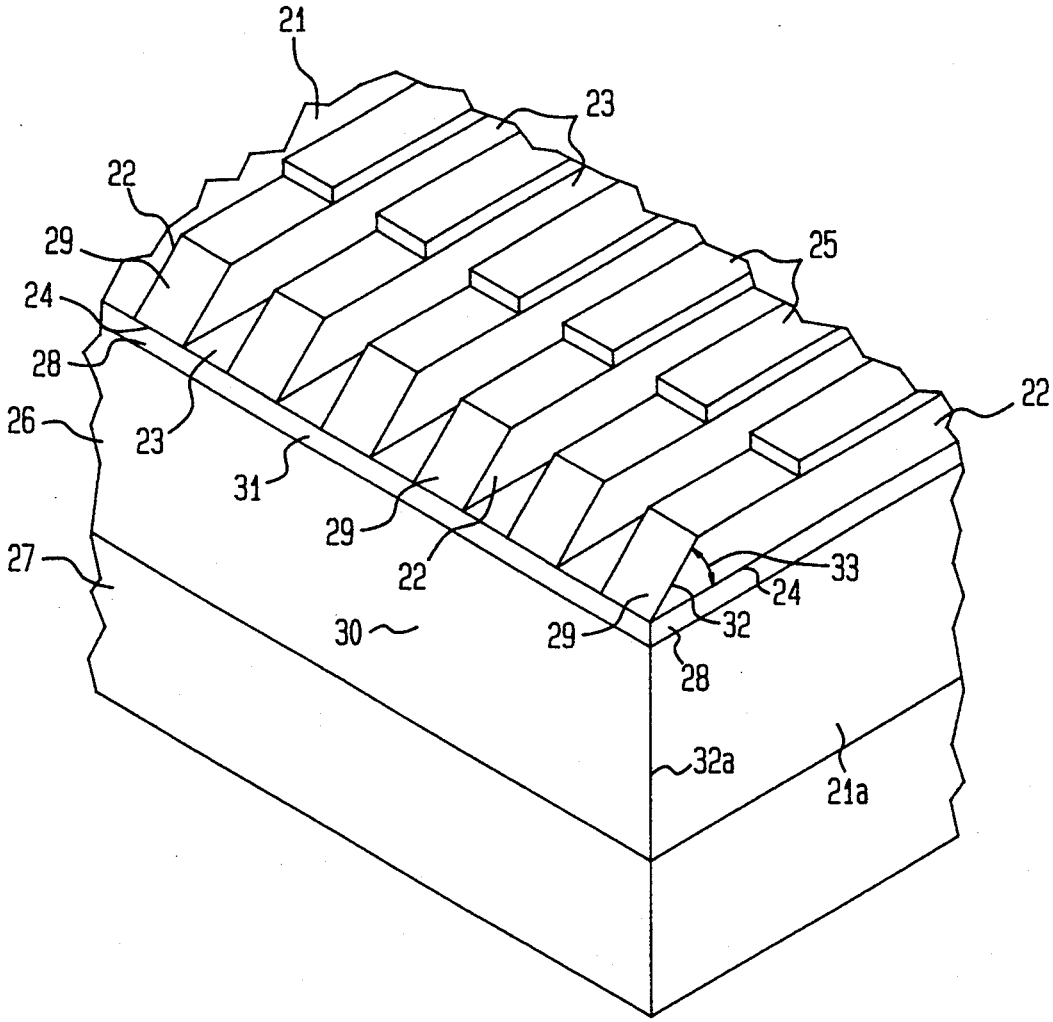
FIG. 2 is a schematic perspective inverted view showing the various parts, including the exposed end faces of the electrodes, plus the barrier layer and substrate, of the print head shown in FIG. 1.

Referring now to FIGS. 1 and 2, there is shown a printing arrangement 20 for resistive ribbon thermal printing in accordance with an embodiment of the present invention.

Arrangement 20 comprises a print head 21, a print head end 21*a*, electrodes 22, interspaces 23, an electrode plane 24, conductors (leads) 25, a substrate 26, a heat sink 27, a barrier (spacing) layer 28, electrode end faces 29, a substrate end face 30, a barrier layer end face 31, a contact plane 32, an end plane 32*a*, an angle 33 (indicated by a double arrow), a ribbon 40, a base layer 41, a ground layer 42, a dye layer 43, a contact surface 44, a transfer surface 45, a contact interface 46, a base layer bulk 47, an oxide layer 48, an air gap 50, a receiver 51, a receiving surface 52, a platen contacting surface 53, a moving direction 54 (indicated by an arrow), a platen 55, a compression nip 56 (indicated by a dashed arrow), a current source 57, and a circuit 58 (indicated by a dashed line).

Print head 21 comprises a linear array, i.e., a row, of side by side, closely spaced apart, electrically and thermally conductive electrodes 22, separated by interspaces 23, and lying in a common electrode plane 24. Electrodes 22 are of common polarity (i.e., all anodes or all cathodes, depending on the electrical energizing circuit arrangement), and are selectively energized by conductors (leads) 25 connected to a source of electrical energy, e.g., current pulses (not shown).

Electrodes 22 are uncoated and are normally mechanically supported by an electrically non-conductive substrate 26 connected to a heat sink 27 remote from electrodes 22. However, in accordance with the invention, an electrically non-conductive and thermally insulating barrier (spacing) layer 28 is interposed between electrodes 22 and substrate 26 to space substrate 26 physically from electrodes 22.

Electrodes 22 are formed of high hardness, electrically conductive (low electrical resistance) uniform material (i.e., of homogeneous nature throughout), such as non-oxide ceramic (refractory) material, and particularly metal carbide, metal nitride or non-metal carbide, e.g., tungsten carbide, silicon carbide, zirconium carbide, titanium carbide, titanium nitride, and the like. Electrodes 22 typically have a Vickers hardness (diamond pyramid) of at least about 1,500 Hv and thus possess high wear resistance.

Substrate 26 is formed of electrically non-conductive (high electrical resistance, insulating), and preferably high hardness, material (i.e., of homogeneous nature throughout), such as ceramic (refractory) material of selective thermal conductivity, and particularly metal oxide (including mixed metal oxide), metal nitride, mixed metal oxide and non-metal oxide, or glass-ceramic, e.g., beryllium oxide, aluminum nitride, magnesia, alumina, magnesium aluminate, titania, calcium titanate, barium titanate, zirconia, forsterite, steatite, fotoceram, pyroceram, and the like. Substrate 26 typically has a Vickers hardness of at least about 500 Hv, such as about 500 to 1,700 Hv. Substrate 26 has a selective thermal conductivity, e.g., of at least about 2 W/m.C. (watts per meter per degree C.) to about 260 W/m.C., or higher, such as a low thermal conductivity of about 2 to below about 20, preferably about 5 to below about 20, W/m.C., as in the case of pyroceram, fotoceram, steatite, titania and alumina of 95% purity, or a high thermal conductivity of at least about 20 to about 260 W/m.C., or higher, preferably about 20 to 80, and more preferably about 20 to 60, W/m.C., as in the case of alumina of at least 99% purity, magnesia and beryllium oxide, as desired. In particular, substrate 26 has a thermal conductivity of preferably about 2 to 60, and more preferably about 5 to 60, W/m.C.

Barrier layer 28 is formed of electrically non-conductive (high electrical resistance, insulating) and thermally insulating (low thermal conductivity) uniform material (i.e., of homogeneous nature throughout), such as ceramic (refractory) material of low thermal conductivity, and particularly non-metal oxide, metal oxide (including mixed metal oxide), or mixed metal oxide and non-metal oxide, e.g., silicon dioxide, zirconia, refractory glass (e.g., having a high softening or melting point above about 600 degrees C.), and the like, and is preferably formed of silicon dioxide.

Barrier layer 28 is formed in conventional manner such as by sputtering application of silicon dioxide or zirconia, or silk screen application and fritting of a layer of high temperature (high melting point) glass powder, on the surface of substrate 26 to be connected to electrodes 22, and then connecting electrodes 22 thereto in conventional manner. Silicon dioxide may be used in the form of fused quartz.

Heat sink 27 is formed of heat conductive material such as aluminum, and is connected to substrate 26 remote from barrier layer 28 and electrodes 22. Heat sink 27 is conventional and may have a finned structure to aid heat transfer (dissipation), if desired.

Electrodes 22 correspondingly terminate in exposed end faces (contact faces) 29 at the printing portion of print head 21 located at print head end 21*a*. Substrate 26 terminates in a recessed (remote) substrate end face (non-contact face) 30 and barrier layer 28 terminates in a recessed (remote) barrier layer end face (non-contact face) 31, at print head end 21*a*. The row of electrodes 22 in electrode plane 24, plus barrier layer 28 and substrate 26, are in abutment in succession in moving direction 54. Barrier layer 28 is interposed between the row of electrodes 22 and substrate 26 for thermally separating electrodes 22 from substrate 26. The row of electrode end faces 29 lies in a common contact plane 32 which extends at an acute contact angle 33, e.g., of about 30 to 45 degrees, to electrode plane 24.

As barrier layer end face 31 and substrate end face 30 are recessed, they are arranged in spaced relation to contact plane 32 and remote from electrode end faces 29 at print head end 21*a* (and remote from resistive ribbon 40). Typically, barrier layer end face 31 and substrate end face 30 lie in a print head recessed end plane 32*a* generally normal to electrode plane 24 and at an obtuse angle to contact plane 32, at print head end 21*a*.

Resistive ribbon 40 is conventional, e.g., with an upper electrically resistive base (supporting substrate) layer 41, an intermediate electrically resistive ground layer 42 as explained below, and a lower heat transferable dye bearing layer 43. Base layer 41 defines upper contact surface 44 and dye layer 43 defines lower transfer surface 45.

Contact surface 44 forms a contact interface 46 with print head 21 providing a contact electrical resistance at electrode end faces 29.

Base layer 41, whose exposed surface defines contact surface 44, has an electrically resistive bulk 47 providing a bulk electrical resistance. Base layer 41 may be a heat-resistant polymer layer in which bulk 47 is a carbon particle loaded polymer such as polycarbonate, with a softening or melting point above the dye transfer temperature.

Ground layer 42 is coated with an oxide layer 48 (shown schematically in FIG. 1), forming an interface electrical resistance. Ground layer 42 preferably is aluminum, such that the oxide layer 48 which grows thereon (upon attack by air) is electrically resistive aluminum oxide. Ground layer 42 may also be copper, gold, graphite, and the like.

Dye layer 43 comprises dye heatable to a given transfer temperature for transfer across air gap 50 from transfer surface 45 of ribbon 40 to receiver 51 at its facing image receiving upper surface 52. Receiver 51 underlies ribbon 40 remote from contact surface 44 and print head 21 and has an opposed platen contacting lower surface 53 to support receiver 51 on a platen 55 in known manner. Platen 55 may be of flat or cylindrical support surface type. Print head 21 forms a compression nip 56 with platen 55 under sufficient force for efficient compliant pressure contact of electrode end faces 29 in contact plane 32 with the facing contact surface 44 of ribbon 40.

The operating temperature is determined by the dye transfer temperature, i.e., the temperature at which the dye melts or ,sublimes for flowable transfer from dye layer 43 across air gap 50 to receiving surface 52 of receiver 51. Air gap 50 is defined by the roughness of receiving surface 52, e.g., when plain (uncoated) paper, traceable to the rough surface character of paper.

Air gap 50 is normally present if a sublimable dye is used (sublimation transfer mechanism). If a meltable, e.g., wax based, dye is used (melt diffusion transfer mechanism), air gap 50 may be omitted. This is usually the case when receiver 51 has a receiving coating, e.g., of polymer material on a paper substrate, or is itself formed of a polymer film, e.g., a transparent polymer film, such that receiving surface 52 is smooth and even (ideal receiver), essentially eliminating air gap 50. However, it is known to embed protruding fine particles (beads) in the polymer surface defining receiving surface 52 to form air gap 50, if sublimable dye is used.

The dye transfer temperature depends on the dye and its mode of transfer, e.g., by melt diffusion or by sublimation, and on the material nature and degree of roughness of receiving surface 52. The operating temperature is usually about 250 to 500 degrees C.

Typically, the thickness of base layer 41 is about 15 microns (about 0.0006 inch), and that of ground layer 42 is about 0.1 micron (about 0.000003937 inch). If receiver 51 is plain paper, dye layer 43 has a greater thickness, e.g., of about 4 microns (about 0.000157 inch), to assure localized transfer of sufficient dye to cover the rough receiving surface 52. If receiver 51 has a polymer coating or is itself a polymer film, dye layer 43 has a lesser thickness, e.g., of about 0.5 micron (0.0000196 inch), as less dye is needed to cover the (ideal) receiving surface 52.

Print head 21 selectively applies electrical energy (current pulses) via selective individual electrode end faces 29 to contact surface 44 of ribbon 40, during sliding pressure contact and relative movement therebetween in movement direction 54, for selective resistive heating of the dye in dye layer 43 for transfer from ribbon 40 to receiver 51 to form dye images on receiving surface 52, under control of known control means, e.g., having a programmed microprocessor (not shown), in conventional manner. The electrical energy supplied to ribbon 40 generates resistive heat at contact interface 46 (at electrode end faces 29), in bulk 47 and at oxide layer 48.

Current return occurs by travel through ground layer 42 to a reference potential, e.g., ground, by known means (not shown) at a point in ground layer 42 remote from electrodes 22, i.e., spaced in movement direction 54 from that at which print head 21 contacts ribbon 40 at contact interface 46.

Thus, in conventional manner, energizing current from a source 57 passes via conductors 25 and electrodes 22 to ribbon 40 and returns via ground layer 42 and the ground back to the current source 57 to complete an energizing circuit 58 containing said control means, e.g., having a programmed microprocessor (not shown).

The arrangement of ribbon 40 and receiver 51 may be regarded as constituting a system of six individual layers, three of which carry current (resistance layers) and all six of which conduct heat.

The three current carrying layers are (1) the contact resistance layer defined by contact interface 46 (contact resistance), which exists between the current supplying electrodes 22 and the polymer support layer defined by base layer 41 of ribbon 40, (2) the polymer support layer defined by base layer bulk 47 (bulk resistance) of base layer 41, and (3) ground layer 42, e.g., of metal such as aluminum, on which oxide layer 48 (interface resistance) is disposed. Generally, oxide layer 48 grows as an oxide film on ground layer 42 which serves as the electrical ground of the system, the oxide film being particularly significant, if not crucial in the case of a metal ground layer 42, for producing a desired high electrical resistance in the current flow path immediately adjacent dye layer 43, which results in high (locally intense) heating very close to the dye.

The remaining three layers are (4) dye layer 43, (5) the gap defined by air gap 50, to the extent that it exists in the system, e.g., across which dye sublimation occurs, and (6) the receiver layer defined by receiver 51.

FIG. 1 shows ribbon 40 and receiver 51 moving in movement direction 54, and print head 21 as stationary. However, print head 21 may move in the opposite direction while ribbon 40 and receiver 51 are stationary. Such relative movement occurs in known manner.

Base layer 41 and ground layer 43 convert electrical energy applied by electrodes 22 to ribbon 40 at contact interface 46 to resistance heat that heats the dye in dye layer 43 to a given dye transfer temperature. However, some of this generated resistance heat is transferred to electrodes 22, which are designed to operate as electrical conductors, rather than as heat generating resistors, as electrode end faces 29 are in sliding pressure contact with ribbon 40.

To prevent undesired transfer of heat from ribbon 40 to electrodes 22, and therefrom to substrate 26 of given thermal conductivity, e.g., about 2 to 80 W/m.C., or higher, and in turn to heat sink 27, barrier layer 28 is provided according to the invention.

Barrier layer 28 has a thermal conductivity which is at most about one-tenth of the thermal conductivity of substrate 26, and a selective thickness sufficient to retard heat transfer from electrodes 22 to substrate 26. The thickness of barrier layer 28 is desirably about 1 to 50 microns (0.00004 to 0.002 inch). Thus, for a thermal conductivity of substrate 26 of about 2 to 60 W/m.C., the thermal conductivity of barrier layer 28 is concordantly in the range of about 0.2 to 6 W/m.C. Generally, the thermal conductivity of barrier layer 28 does not exceed about 6 W/m.C., even though this value may be less than one-tenth of the thermal conductivity value of substrate 26.

For maximum heat conservation, i.e., to minimize heat transfer to substrate 26 from electrodes 22, substrate 26 preferably has a low thermal conductivity, e.g., about 2 to below about 20 W/m.C., and barrier layer 28 has a concordant thermal conductivity, e.g., in the range of about 0.2 to 2 W/m.C. Barrier layer 28 favorably has a thermal conductivity of about 0.8 to 1.4, or about 0.8 to 1, W/m.C. up to one-tenth of that of substrate 26.

The lower the thermal conductivity of barrier layer 28, the better the control of heat loss from electrodes 22 to substrate 26. Since barrier layer end face 31 and substrate end face 30, being recessed, are spaced from contact plane 32 and remote from electrode end faces 29, and thus do not contact ribbon 40, there is no heat loss from ribbon 40 directly to substrate 26,, e.g., when substrate 26 has high thermal conductivity. In fact, the presence of barrier layer 28 between electrodes 22 and substrate 26 according to the invention renders essentially irrelevant the particular thermal conductivity of substrate 26, as demonstrated below.

A relatively thick barrier layer 28, e.g., about 25 to 50 microns thick, retards heat flow from electrodes 22 to substrate 26, maintaining the slow cooling electrodes 22 at relatively high temperature after current pulsing ceases, thus reducing heat loss from ribbon 40 to electrodes 22 as they are already relatively hot compared to the ribbon temperature. In this case, the operation is energy efficient. For slow printing, sharp images are formed. For fast printing or high clarity near-photographic printing, the images are less sharp than for cooler operating electrodes 22.

Since a thick barrier layer 28 functionally replaces substrate 26 as temperature control means, substrate 26 may be selected on the basis of non-thermal conductivity criteria alone. Other things being equal, barrier 28 achieves temperature control of electrodes 22 regardless of the low or high thermal conductivity of substrate 26, permitting use of a high thermal conductivity substrate 26.

A relatively thin barrier layer 28, e.g., about 1 to 25 microns thick, cools down electrodes 22 relatively rapidly after current pulsing ceases, thus increasing heat loss from ribbon 40 to electrodes 22 as they are maintained relatively cool compared to the ribbon temperature. In this case, the operation is less energy efficient. For slow printing, sharp images are formed. For fast printing or high clarity near-photographic printing, sharp images are also formed, due to the cooler operating electrodes 22.

As is clear from the foregoing, the composite portion of print head 21 defined by the combination of barrier layer 28 and substrate 26 constitutes a non-uniform thermal conductivity structure, in that the uniform ceramic material of barrier layer 28 has a thermal conductivity of at most about one-tenth of that of the uniform ceramic material of substrate 26.

Electrode end faces 29 are desirably polished to a highly smooth finish for maximum contact of these exposed (uncoated) end faces with contact surface 44 of ribbon 40 at contact interface 46. As electrode end faces 29 alone contact ribbon 40 during relative movement between print head 21 and ribbon 40, electrode end faces 29 serve to iron ribbon 40 at its contact surface 44, under the applied sliding pressure at compression nip 56.

In one illustrative embodiment, for a print head 21 with a resolution of 300 dpi (dots per inch), electrode end faces 29 have a square shape with a 42.3 micron height D1 in movement direction 54, and a 42.3 micron width D2 in a direction transverse thereto, and interspaces 23 have a 42.3 micron width D3 between electrode end faces 29. The pitch D4 of the 300 dpi electrodes 22 is 3.33 mils, i.e. 0.00333 inch (1/300), or 84.6 microns. The pitch is the center to center distance between electrodes 22, or stated another way is the sum of the 42.3 micron width D2 of an electrode end face 29 and the 42.3 micron width D3 of an adjacent interspace 23.

Use of electrode end faces 29 of square shape will generally produce good (favorable) quality text (character) images such as when end face width D2 equals interspace width D3. As end face width D2 increases and interspace width D3 decreases for the given 300 dpi resolution and pitch D4, end face height D1 should also decrease to keep constant the end face contact area, while changing the end face to oblong rectangular shape, i.e., with end face width D2 as its major dimension. Use of electrode end faces 29 of oblong rectangular shape will generally produce good (favorable) quality picture (graphic) images. Maintaining a constant electrode end face contact area provides a constant current density for electrodes 22 (i.e., a constant power consumption for the printer).

The end face contact area roughly determines the pixel size of the transferred dye "dots" that form images on receiving surface 52 of receiver 51. Pixel overlap in the width direction transverse to movement direction 54 is achieved by increasing end face width D2 and decreasing interspace width D3. Depending on the desired degree of pixel overlap, per increasing end face width D2 and decreasing interspace width D3, end face height D1 can be decreased to form such an oblong shape end face of the same contact area as the square end face. This permits favorable quality picture images to be obtained with increasing pixel overlap while keeping the same end face contact area (constant current density) as with the square end face (that produces favorable quality text images).

For a 300 dpi print head 21 with a constant electrode end face area, end face height D1 may be about 42.3 to 29.8 microns, and concordantly end face width D2 may be about 42.3 to 60 microns and interspace width D3 may be about 42.3 to 24.6 microns. For a square end face with a 42.3 micron end face height D1 and width D2, the electrode end face area is 1789 square microns ($42.3 \times 42.3$), and interspace width D3 is 42.3 microns. For such an oblong shaped end face with a 29.8 micron end face height D1 and 60 micron end face width D2, the electrode end face area is 1788 square microns ($29.8 \times 60$), and interspace width D3 is 24.6 microns.

A constant electrode end face area, providing a constant current density, is desired, regardless of the shape of electrode end faces 29. This area forms the total contact area of print head 21 in contact with contact surface 44 of ribbon 40. Print head 21 is applied against ribbon 40 at a high force for compliant contact therebetween during relative movement thereof. This force is distributed over the total contact area, typically exerting a pressure of about 2,000 psi at compression nip 56.

For this reason, metal electrodes are not appropriate according to the invention since they possess insufficient hardness and undergo accelerated wear under the contemplated operating conditions, e.g., at a temperature of about 250 to 500 degrees C. and a pressure of about 2,000 psi at compression nip 56. Instead, according to the invention, electrodes 22 are formed of appropriate long-wearing refractory material, i.e., are formed of a heat-resistant electrically conductive non-oxide ceramic material, e.g., having a Vickers hardness of at least about 1,500 Hv.

Other things being equal, it is known that if the substrate is recessed relative to the electrodes so that no substrate end face (contact face) is exposed, i.e., for contact with the resistive ribbon, this force is concentrated at the electrode end faces, exerting a high pressure, typically about 2,000 psi, on the ribbon. Modifying the print head to provide the substrate with an exposed end face (contact face), i.e., lying in the contact plane of the electrode end faces, increases the area of contact with the ribbon and reduces the contact pressure under the same such force, typically to about 225 psi. Thus, for an equivalent force, use of an exposed substrate end face (contact face) increases the total contact area of the print head and reduces the contact pressure on the ribbon in direct proportion to the increase in contact area.

While end face width D2 and interspace width D3 are determined by the, e.g., 300, dpi resolution of print head 21, end face height D1 is determined by angle 33, preferably of about 30 to 45 degrees. Too large an angle 33 (above 45 degrees) causes wrinkling and damage of ribbon 40, under the contact pressure, and unduly decreases and thus limits electrode end face height D1 and the electrode end face area for a given electrode end face width D2. Too small an angle 33 (below 30 degrees) unduly increases electrode end face height D1 and the electrode end face area for a given electrode end face width D2, and increases contact friction.

Thus, for a given pitch D4, end face width D2 determines interspace width D3, the pixel width dimension in a direction transverse to movement direction 54, and the degree, if any, of pixel width overlap as end face width D2 increases and interspace width D3 decreases. Angle 33 determines end face height D1, which decreases as angle 33 increases. For a given end face width D2, angle 33 also determines whether electrode end faces 29 are square or oblong in shape. The energizing pulsing conditions and speed of relative movement between print head 21 and ribbon 40, plus angle 33, determine the pixel height dimension and any pixel overlap in movement direction 54.

Table 1 shows typical electrically conductive non-oxide ceramic refractory materials usable for electrodes 22, and their individual electrical (volume) resistivity (microhm-cm) and Vickers hardness (kg/sq mm) values.

TABLE 1

| Electrodes | Electrical Resistivity microhm-cm | Vickers Hardness kg/m$^2$ |
|---|---|---|
| Tungsten Carbide (WC) | 20 | 1600–2200 |
| Silicon Carbide (SiC) | 150 | 4000 |
| Zirconium Carbide (ZrC) | 70 | 2600 |
| Titanium Carbide (TiC) | 215 | 2500 |
| Titanium Nitride (TiN) | 22 | 4000 |

It is seen from Table 1 that these electrode ceramic refractory materials all have low electrical resistivity (high electrical conductivity) and high hardness levels.

Table 2 shows typical electrically, non-conductive ceramic refractory materials of high thermal conductivity usable for substrate 26, and their individual high thermal conductivity (W/m.C.) (in descending order) and Vickers hardness (kg/sq mm) values.

TABLE 2

| Substrate | Thermal Conductivity W/m.C | Vickers Hardness kg/mm$^2$ |
|---|---|---|
| Beryllium Oxide (BeO) | 258.0 | 1200 |
| Aluminum Nitride (AlN) | 170.0 | 1200 |
| Magnesia (MgO) | 60.5 | 700 |
| Alumina ($Al_2O_3$ 99.5%) | 25.1 | 1700 |
| Alumina ($Al_2O_3$ 99.0%) | 25.1 | 1650 |

It is seen from Table 2 that these ceramic refractory materials usable for the substrate all have acceptable hardness levels. Being electrical insulators, they also have high electrical resistivity values, such being equal to or greater than $1\times10^{14}$ microhm-cm for all the listed materials.

Table 3 shows typical electrically non-conductive ceramic refractory materials of low thermal conductivity usable for substrate 26 or for barrier layer 28, as the case may be, and their individual low thermal conductivity (W/m.C.) (in descending order) and pertinent Vickers hardness (kg/sqmm) values.

TABLE 3

| Substrate and Barrier Layer | Thermal Conductivity W/m.C | Vickers Hardness kg/mm$^2$ |
|---|---|---|
| Alumina ($Al_2O_3$ 95.0%) | 16.0 | 1000 |
| Magnesium Aluminate ($MgO.Al_2O_3$) | 13.8 | 1100 |
| Titania ($TiO_2$) | 5.4 | 780 |
| Calcium Titanate ($CaTiO_3$) | 5.3 | 880 |
| Barium Titanate ($BaTiO_3$) | 4.2 | 880 |
| Zirconia (ZrO2) | 3.8 | 1200 |
| Forsterite ($2mgO.SiO_2$) | 3.8 | 800 |
| Steatite ($MgO.SiO_2$) | 3.0 | 550 |
| Fotoceram | 2.6 | 540 |
| Pyroceram | 2 | 700 |
| Fused Quartz ($SiO_2$) | 1.3 | |

It is seen from Table 3 that these ceramic refractory materials usable for the substrate or for the barrier layer, as the case may be, have acceptable hardness levels, their relative level of thermal conductivity determining their selection for use as the substrate or barrier layer material as earlier defined. As electrical insulators, they also have high electrical resistivity values, such being equal to or greater than $1\times10^9$ microhm-cm for all the listed materials.

It is noted that the thermal conductivity of alumina increases with its increasing purity.

It is further noted that since substrate 26 and barrier layer 28 do not contact ribbon 40, their hardness levels provide appropriate structural integrity, whereas the stated minimum hardness level of electrodes 22 is necessary to assure high wear resistance, as aforesaid.

Figure 3:
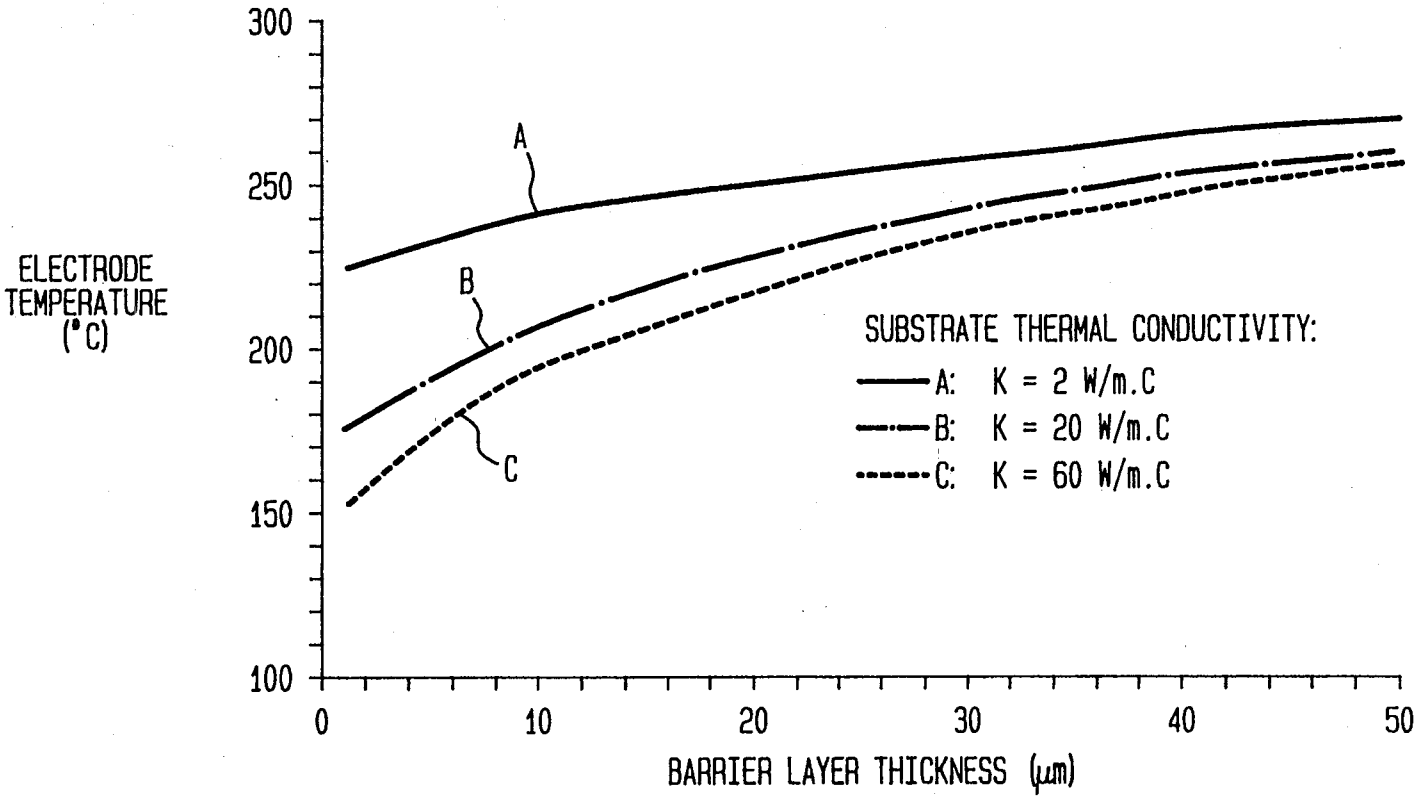
FIG. 3 is a graph showing the calculated relationship in a thermal model between the thickness of a barrier layer of given low thermal conductivity and the electrode temperature at a posed ribbon/electrode interface temperature for different substrates of given thermal conductivity.

Referring now to FIG. 3, a graph is set forth illustrating calculations of the effect in a thermal model of the thickness of barrier layer 28, based on a given thermal conductivity simulating silicon dioxide (fused quartz), on the maximum temperature of electrodes 22 in the arrangement of FIGS. 1 and 2, as a function of both the thermal conductivity of substrate 26, based on ceramic refractory materials of three different given thermal conductivities, and the thickness of barrier layer 28.

The graph shows the maximum predicted temperature in degrees C. of electrodes 22 (ordinate) for different thermal conductivities (k) of substrate 26 (curves A, B and C) and different thicknesses (h) in microns of barrier layer 28 (abscissa). The calculations assume a ribbon/electrode interface temperature of 300 degrees C. (between electrodes 22 and ribbon 40 at contact surface 44), and the presence of heat sink 27 on substrate 26 so as to maintain at 25 degrees C. the surface of substrate 26 connected thereto.

The computation effected to derive the data in FIG. 3 was performed using a commercial finite element software package capable of performing heat transfer analysis. A three dimensional, steady state, thermal model of the print head structure was constructed, with discrete electrodes attached to the substrate but separated by a low conductivity barrier layer similar to, and thus emulating, the structure shown in FIGS. 1 and 2. It was assumed that the electrodes touch a resistive ribbon having a surface temperature of 300 degrees C. This was taken from IBM (International Business Machines Corp.) data and is consistent with the modelling of the heat generation and transfer in the resistive ribbon as contemplated herein. It was also assumed that the heat flux (flow) into the electrodes is 40 W/sq cm.C (watts per sq cm per degree C.). This is based on IBM experimental data presented in the literature. It was further assumed that the substrate surface opposite the surface having the barrier layer and electrodes is connected to a heat sink maintained at an arbitrary temperature, chosen as 25 degrees C. for the calculations. Symmetry boundary conditions in the model imply a row of discrete electrodes all contacting the hot (300 degree C.) resistive ribbon.

The only physical property of the barrier layer required in such steady state thermal analysis is its thermal conductivity, and this was taken as 1 W/m.C., which is similar to the thermal conductivity value for silicon dioxide, and thus emulates use of a silicon dioxide barrier layer, i.e., for the taken barrier layer thickness range of 2 to 50 microns. The substrate thermal conductivity was taken as 2, 20 and 60 W/m.C., respectively.

It is seen from FIG. 3 that as barrier layer 28 becomes very thick, i.e., at 25 to 50 microns, the maximum calculated temperature of electrodes 22 becomes insensitive to the thermal conductivity of substrate 26, whether it is calculated as having a low thermal conductivity of 2 W/m.C. (curve A), an intermediate thermal conductivity of 20 W/m.C. (curve B), or a high thermal conductivity of 60 W/m.C. (curve C). This allows selection of substrate 26 on the basis of non-thermal conductivity criteria alone if electrodes 22 are desired to remain hot, i.e., to operate at high temperature relative to the dye transfer temperature in ribbon 40.

It is also seen from FIG. 3 that as barrier layer 28 becomes thin, i.e., up to about 25 microns thick, the maximum calculated temperature of electrodes 22 varies with the thermal conductivity of substrate 26 (curves A, B and C). Here, the calculated temperature of electrodes 22 increases as the thermal conductivity of substrate 26 decreases from a high of 60 W/m.C. (curve C), to an intermediate of 20 W/m.C. (curve B), and then to a low of 2 W/m.C. (curve A). Thus, if it is desired to maintain electrodes 22 at a low temperature relative to the dye transfer temperature in ribbon 40, i.e., for high clarity text or fast printing, a thin barrier layer 28 with a high thermal conductivity substrate 26 may be used.

Hence, per the invention, electrode temperature is selected in dependence on the intended type printing operation, by selecting the barrier layer thermal conductivity in relation to that of the substrate, in conjunction with the barrier layer thickness. This is confirmed by the cognate showings in FIGS. 4 to 9.

Figure 4:
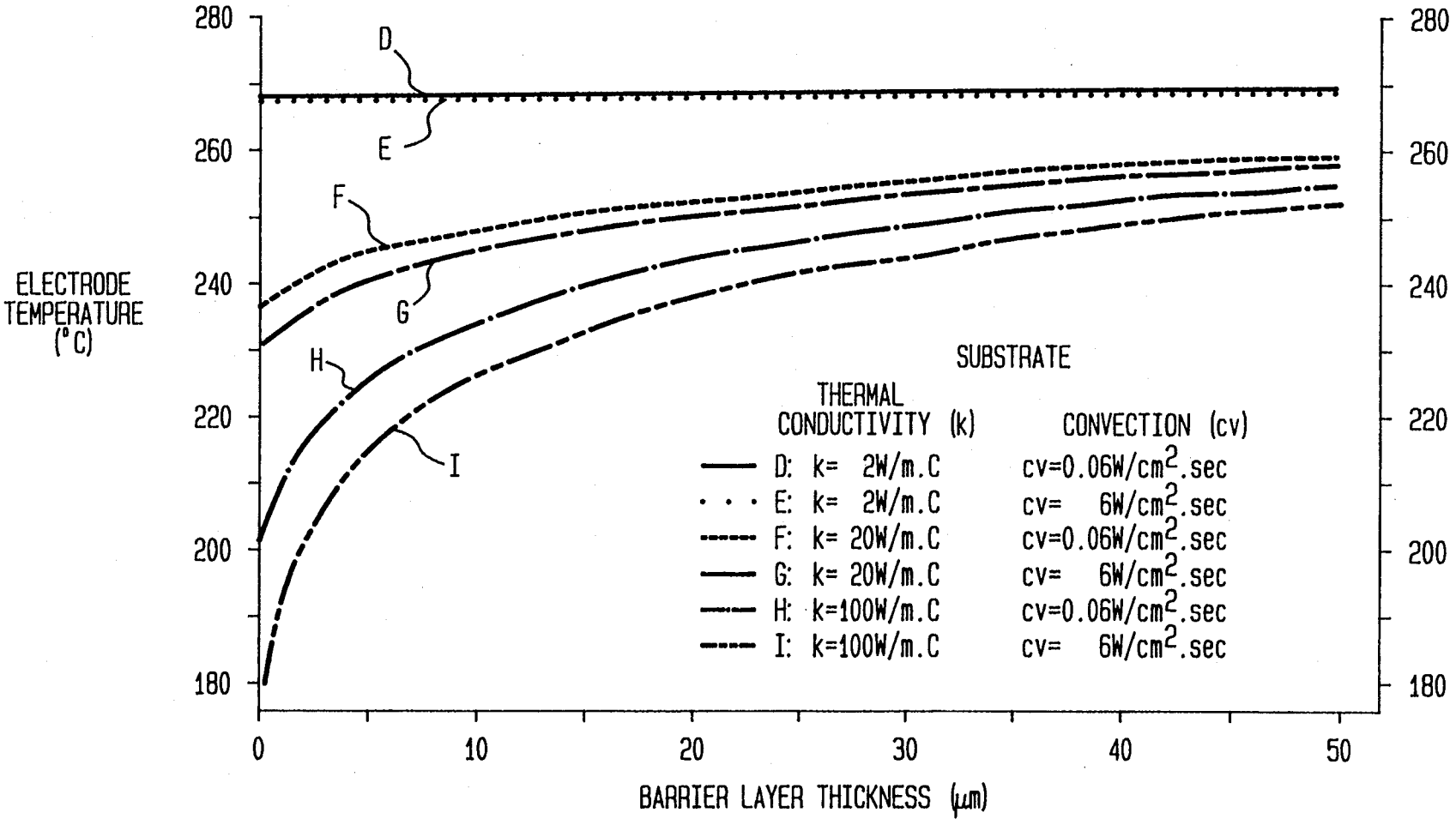
FIG. 4 is a graph similar to FIG. 3, in this case with the thermal model using different thermal conductivity substrates with and without a heat sink connected thereto.

Referring now to FIG. 4, a graph similar to FIG. 3 is set forth illustrating like calculations of the effect in the same thermal model of the thickness of barrier layer 28 on the maximum temperature of electrodes 22 in the arrangement of FIGS. 1 and 2 as a function of both the thermal conductivity of substrate 26 taken at three different values, and the barrier layer thickness.

The calculations assume a ribbon/electrode interface temperature of 300 degrees C. (between electrodes 22 and ribbon 40 at contact surface 44), and cover a first condition in which heat sink 27 is considered absent from substrate 26 (curves D, F and H), and a second condition in which heat sink 27 is considered present on substrate 26 cooled by forced air at a temperature of 25 degrees C. (curves E, G and I). The computation for deriving the data in FIG. 4 was performed in the same way as for the data in FIG. 3, modified to cover the first and second conditions regarding the absence or presence of heat sink 27.

FIG. 4 shows the maximum predicted electrode temperature in degrees C. (ordinate) for three different substrate thermal conductivities (k) taken at 2 (curves D and E), 20 (curves F and G) and 100 (curves H and I) W/m.C., respectively, and two different substrate convections (cv) taken at 0.06 W/sq cm. sec (watts per sq cm per sec) to simulate the first condition in which heat sink 27 is absent (curves D, F and H) and at 6 W/sq cm. sec to simulate the second condition in which heat sink 27 is present (curves E, G and I), over a barrier layer thickness (h) range of 1 to 50 microns (abscissa) for a barrier layer thermal conductivity taken at 1 W/m.C.

It is seen from FIG. 4 that as the barrier layer thickness increases, the maximum electrode temperature becomes increasingly insensitive to the substrate thermal conductivity, both under the first condition in which heat sink 27 is absent and substrate convection is calculated at a low value of 0.06 W/sq cm.sec (curves D, F and H), and under the second condition in which heat sink 27 is present and substrate convection is calculated at a high value of 6 W/sq cm.sec (curves E, G and I).

At a low substrate thermal conductivity of 2 W/m.C. (curves D and E), the maximum electrode temperature is essentially the same in the absence (curve D) or presence (curve E) of heat sink 27, throughout the barrier layer thickness range (curves D and E coincide). At an intermediate substrate thermal conductivity of 20 W/m.C. (curves F and G), the maximum electrode temperature is moderately higher in the absence (curve F) compared to the presence (curve G) of heat sink 27, throughout the barrier layer thickness range, with the temperature difference therebetween moderately decreasing with increasing barrier layer thickness. At a high substrate thermal conductivity of 100 W/m.C. (curves H and I), the maximum electrode temperature is markedly higher in the absence (curve H) compared to the presence (curve I) of heat sink 27, throughout the barrier layer thickness range, with the temperature difference therebetween markedly decreasing with increasing barrier layer thickness.

For both the 0.06 and 6 W/sq cm.sec convection values simulating the first and second conditions, respectively, FIG. 4 shows that at a low substrate thermal conductivity of 2 W/m.C. (curves D and E), the maximum electrode temperature becomes slightly more insensitive to the substrate thermal conductivity with increasing barrier layer thickness, such that barrier layer 28 provides a selective low degree of electrode temperature control at a barrier layer thermal conductivity of 1 W/m.C. compared to a substrate thermal conductivity of 2 W/m.C. In turn, at an intermediate substrate thermal conductivity of 20 W/m.C. (curves F and G), the maximum electrode temperature becomes moderately insensitive to the substrate thermal conductivity with increasing barrier layer thickness, such that barrier layer 28 provides a selective intermediate degree of electrode temperature control at a barrier layer thermal conductivity of 1 W/m.C. compared to a substrate thermal conductivity of 20 W/m.C. Furthermore, at a high substrate thermal conductivity of 100 W/m.C. (curves H and I), the maximum electrode temperature becomes markedly insensitive to the substrate thermal conductivity with increasing barrier layer thickness, such that barrier layer 28 provides a selective high degree of electrode temperature control at a barrier layer thermal conductivity of 1 W/m.C. compared to a substrate thermal conductivity of 100 W/m.C.

In general, the showing in FIG. 4 reflects the same advantages as that of FIG. 3 (whether heat sink 27 is absent or present). Accordingly, as barrier layer 28 becomes thick, the maximum electrode temperature becomes insensitive to the substrate thermal conductivity, allowing substrate selection on the basis of non-thermal conductivity criteria alone if high temperature electrode operation is desired. Conversely, as barrier layer 28 becomes thin, the maximum electrode temperature varies more particularly with the substrate conductivity, the electrode temperature increasing as the substrate thermal conductivity decreases, allowing low temperature electrode operation by use of a high thermal conductivity substrate.

Figure 5:
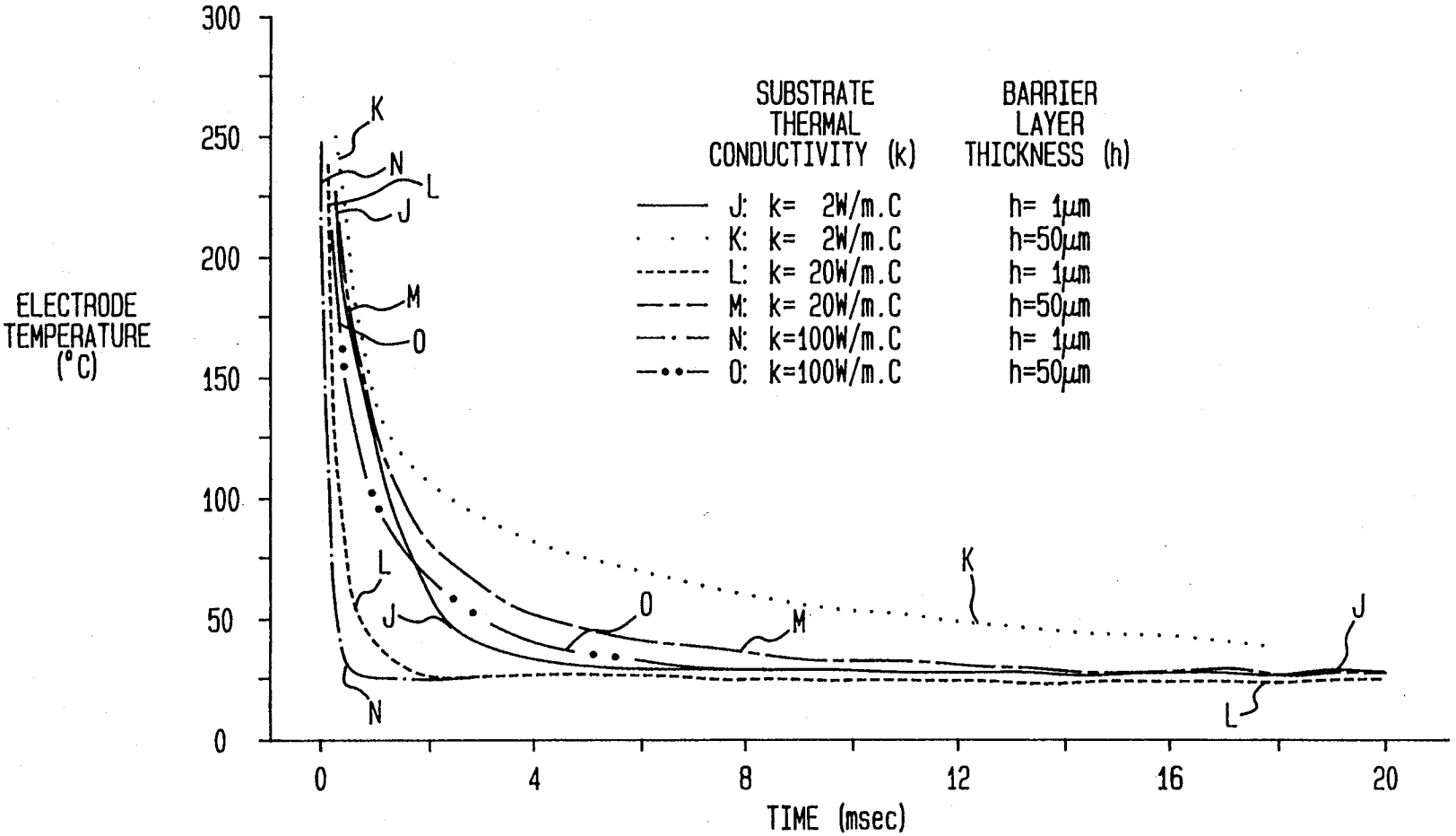
FIG. 5 is a graph of the electrode cool down rate in the thermal model upon ceasing electric current input to the electrodes.

Referring now to FIG. 5, a graph is set forth illustrating calculations of the predicted cool down rate in the same thermal model as used for FIGS. 3 and 4, of electrodes 22 in the arrangement of FIGS. 1 and 2, after stopping the electric current input to the electrodes, as a function of both the thermal conductivity of substrate 26, taken at the same three values as in FIG. 4, and at two thicknesses of barrier layer 28. The calculations assume said ribbon/electrode interface temperature of 300 degrees C. and the absence of heat sink 27.

FIG. 5 shows the effect of the substrate thermal conductivity (k) taken at 2 (curves J and K), 20 (curves L and M) and 100 (curves N and O) W/m.C., respectively, and the barrier layer thickness (h) taken at 1 (curves J, n and N) and 50 (curves K, M and O) microns, respectively, for a barrier layer thermal conductivity taken at 1 W/m.C., on the electrode cool down temperature (ordinate) over time (abscissa) in milliseconds (msec), assuming electrodes 22 are at a steady state temperature until electric current input ceases (at. time t=0).

The predicted values in the model are based on a cool down analysis which utilizes the product of the specific heat (sp.h) and mass density (d) of the materials exemplifying substrate 26 and barrier layer 28, in addition to the given thermal conductivities. It is to be noted that for the refractory materials listed in Tables 2 and 3, the product of the specific heat in J/g.C (Joules per gram per degree C.) and mass density in g/cu cm ranges from 2.1 to 2.6 J/cm$^3$.C. (Joules per cu cm per degree C.). Pointedly, in the subject cool down analysis, the lowest value was chosen to simulate the worst case (poorest efficiency).

It is seen from FIG. 5 that reducing the barrier layer thickness from 50 microns (curves K, M and O) to 1 micron (curves J, L and N) permits a more rapid electrode cool down after electric current pulsing of electrodes 22 ceases (at time=0) at the given steady state temperature. For a low substrate thermal conductivity of 2 W/m.C. (curves J and K), electrode cool down is markedly more rapid at 1 micron barrier layer thickness (curve J) compared to a 50 micron barrier layer thickness (curve K). For an intermediate substrate thermal conductivity of 20 W/m.C. (curves n and M), electrode cool down is also markedly more rapid at 1 micron barrier layer thickness (curve L) compared to a 50 micron barrier layer thickness (curve M). For a high substrate thermal conductivity of 100 W/m.C. (curves N and O), electrode cool down is likewise markedly more rapid at 1 micron barrier layer thickness (curve N) compared to a 50 micron barrier layer thickness (curve O).

FIG. 5 shows that at a 1 micron barrier layer thickness (curves J, n and N), electrode cool down is progressively more rapid as the substrate thermal conductivity increases from a low value of 2 W/m.C. (curve J) to an intermediate value of 20 W/m.C. (curve L) and in turn to a high value of 100 W/m.C. (curve N). It similarly shows that at a 50 micron barrier layer thickness (curves K, M and O), electrode cool down is progressively more rapid in like manner as the substrate thermal conductivity increases from 2 W/m.C. (curve K) to 20 W/m.C. (curve M) and in turn to 100 W/m.C. (curve O). These advantages are utilized according to the invention for electrode temperature control during printing operations.

Referring now to FIGS. 6, 7, 8 and 9, four respective graphs similar to FIG. 5 are set forth illustrating like calculations of the predicted cool down rate in the same thermal model of electrodes 22 in the arrangement of FIGS. 1 and 2, after stopping the electric current input to the electrodes, as a function of both the thermal conductivity of substrate 26, based on beryllium oxide (FIG. 6), magnesium oxide (FIG. 7), alumina (FIG. 8) and steatite (FIG. 9), and the thickness of barrier layer 28, taken in each case at 1, 10, 25 and 50 microns, respectively (four curves in each graph). The calculations assume said ribbon/electrode interface temperature of 300 degrees C. and the absence of heat sink 27.

FIGS. 6, 7, 8 and 9 show the effect of the substrate thermal conductivity (k) and barrier layer thickness (h) on the electrode cool down temperature (ordinate) over time (abscissa) in milliseconds, assuming electrodes 22 are at a steady state temperature until electric current input ceases (at time t=0). The predicted values in the model are based on the same cool down analysis and computations as used for the data of FIG. 5, and provide comparable results.

Figure 6:
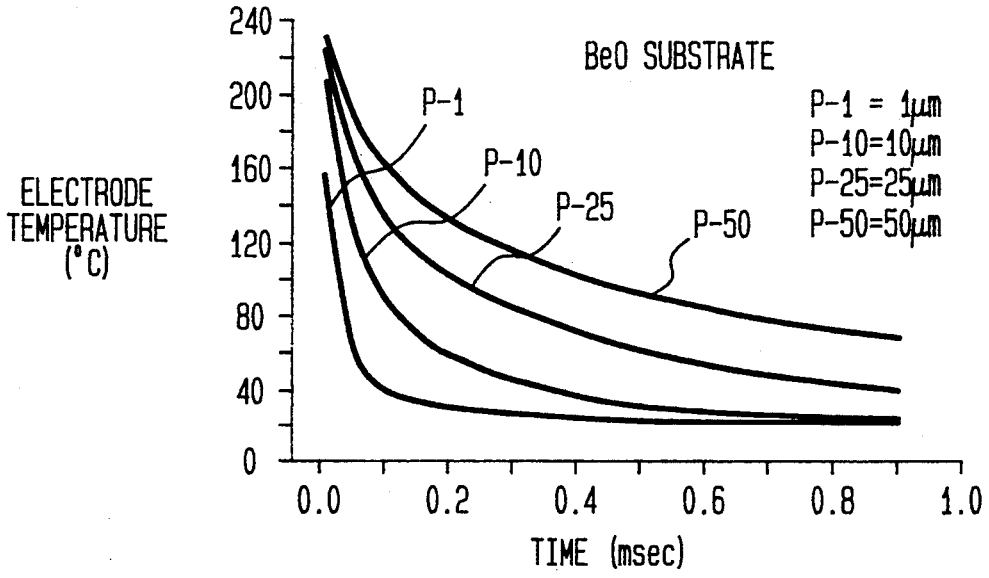
FIG. 6 is a graph similar to FIG. 5 in which a beryllium oxide substrate is used with a barrier layer of 1, 10, 25 and 50 micron thickness in the thermal model.

FIG. 6 shows electrode temperature cool down for the case of a beryllium oxide substrate having a thermal conductivity of 258 W/m.C., a specific heat (sp.h) of 1.05 J/g.C and a mass density (d) of 3 g/cu cm, and a barrier layer thermal conductivity of 1 W/m.C., at a barrier layer thickness of 1 (curve P-1), 10 (curve P-10), 25 (curve P-25) and 50 (curve P-50) microns, respectively.

Figure 7:
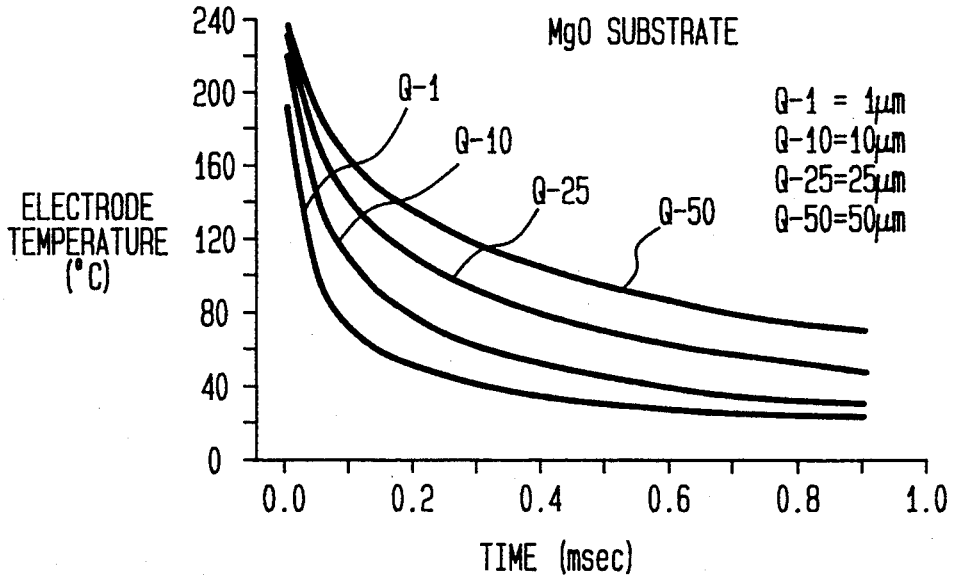
FIG. 7 is a graph similar to FIG. 6 in which a magnesium oxide substrate is used in the thermal model.

FIG. 7 shows electrode temperature cool down for the case of a magnesium oxide substrate having a thermal conductivity of 60.5 W/m.C., a specific heat of 0.8 J/g.C and a mass density of 3 g/cu cm, and a barrier layer thermal conductivity of 1 W/m.C., at a barrier layer thickness of 1 (curve Q-1), 10 (curve Q-10), 25 (curve Q-25) and 50 (curve Q-50) microns, respectively.

Figure 8:
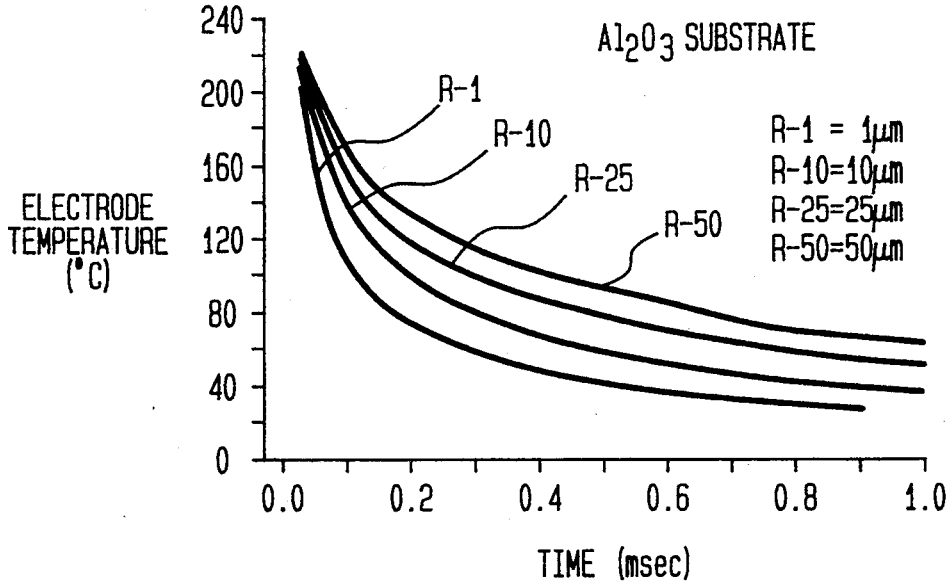
FIG. 8 is a graph similar to FIG. 6 in which an alumina substrate is used in the thermal model.

FIG. 8 shows electrode temperature cool down for the case of an alumina substrate having a thermal conductivity of 25.1 W/m.C., a specific heat of 0.8 J/g.C and a mass density of 3.8 g/cu cm, and a barrier layer thermal conductivity of 1 W/m.C., at a barrier layer thickness of 1 (curve R-1), 10 (curve R-10), 25 (curve R-25) and 50 (curve R-50) microns, respectively.

Figure 9:
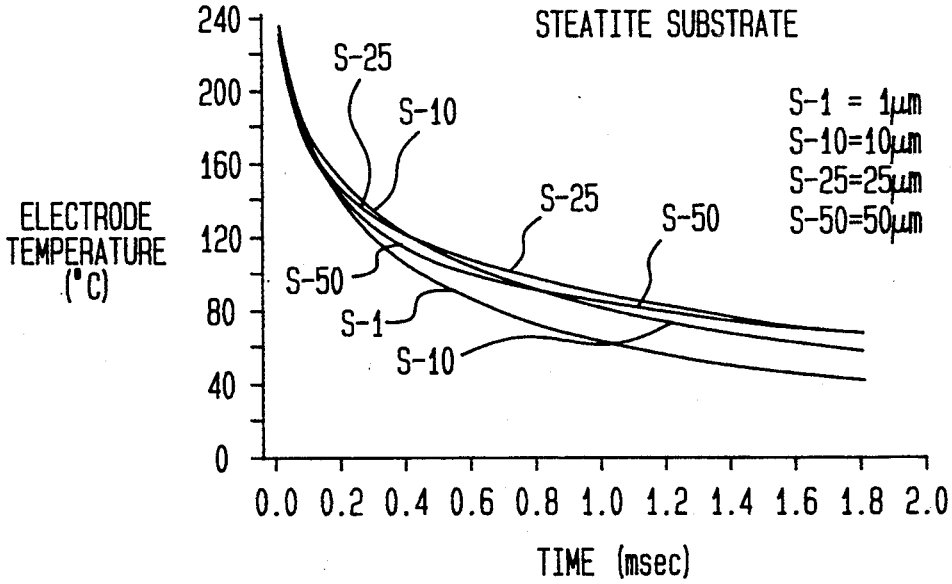
FIG. 9 is a graph similar to FIG. 6 in which a steatite substrate is used in the thermal model.

FIG. 9 shows electrode temperature cool down for the case of a steatite substrate having a thermal conductivity of 3 W/m.C., a specific heat of 0.9 J/g.C and a mass density of 2.7 g/cu cm, and a barrier layer thermal conductivity of 1 W/m.C., at a barrier layer thickness of 1 (curve S-1), 10 (curve S-10), 25 (curve S-25) and 50 (curve S-50) microns, respectively.

The graphs of FIGS. 6 to 9 confirm the related showings in the graph of FIG. 5.

Any suitable electrode pulsing scheme (current level and pulse width), contact pressure, dye, and image receiver may be used, so long as the attendant advantages of the invention are achieved.

The print head of the invention is distinguished by the use of a low thermal conductivity barrier layer of controlled thickness between a selective thermal conductivity substrate and the electrodes, such that only the electrode end faces are in sliding pressure contact with the resistive ribbon while the substrate is located in remote spaced relation to the ribbon, whereby the barrier layer specifically serves to control the temperature of the electrodes.

Accordingly, it can be appreciated that the specific embodiments described are merely illustrative of the general principles of the invention. Various modifications may be provided consistent with the principles set forth.

What is claimed is:

1. A print head for selectively applying electrical energy to a contact surface of an electrically resistive and grounded transfer ribbon bearing heat transferable dye, during sliding pressure contact and relative movement between the print head and ribbon in a movement direction, for selective resistive heating of the dye for transfer to a receiver underlying the ribbon remote from the ribbon contact surface and print head to form images on the receiver, the print head comprising:

a row of side by side, spaced apart, selectively electrically energizable electrodes comprising electrically conductive, high hardness non-oxide ceramic material, and lying in an electrode plane extending crosswise of said movement direction and terminating in a corresponding row of exposed electrode end faces;

an electrically non-conductive substrate having a selective thermal conductivity comprising electrically non-conductive ceramic material; and an electrically non-conductive and thermally insulating barrier layer comprising electrically non-conductive ceramic material having a low thermal conductivity;

the row of electrodes in the electrode plane, the barrier layer and the substrate being in abutment, with the barrier layer interposed between the row of electrodes and the substrate for thermally separating the electrodes from the substrate, and with the row of electrode end faces lying in a contact plane for sliding pressure contact with said ribbon contact surface to apply electrical energy from the electrodes to the ribbon to heat said dye to a transfer temperature; and the barrier layer having a thermal conductivity at most about one-tenth of that of the substrate and a selective thickness sufficient to retard heat transfer from the electrodes to the substrate for controlling the temperature of the electrodes.

2. The print head of claim 1 wherein the substrate has a thermal conductivity of at least about 2 W/m.C., and the barrier layer has a thickness of about 1 to 50 microns.

3. The print head of claim 1 wherein the substrate has a thermal conductivity of about 2 to 260 W/m.C., and the barrier layer has a thermal conductivity of at most about one-tenth of that of the substrate and in the range of about 0.2 to 6 W/m.C. and a thickness of about 1 to 50 microns.

4. The print head of claim 1 wherein the electrodes have a Vickers hardness of at least about 1,500, and the substrate comprises high hardness ceramic material and has a Vickers hardness of at least about 500.

5. The print head of claim 1 wherein the electrodes comprise a carbide ceramic or nitride ceramic material, the substrate comprises an oxide ceramic, nitride ceramic or glass-ceramic material, and the barrier layer comprises an oxide ceramic material.

6. The print head of claim 1 further comprising a heat sink element connected to the substrate remote from the barrier layer and electrodes.

7. The print head of claim 1 wherein the contact plane extends at an acute angle to the electrode plane.

8. The print head of claim 1 wherein the row of electrodes in the electrode plane, the barrier layer and the substrate are in succession in said movement direction, the print head comprises a print head end portion, the substrate terminates in a substrate end face and the barrier layer terminates in a barrier layer end face, the electrode end faces, substrate end face, barrier layer end face and contact plane are located at the print head end portion, and the substrate end face and barrier layer end face are arranged in spaced relation to the contact plane and remote from the electrode end faces.

9. A combination of an electrically resistive and grounded transfer ribbon having a contact surface and bearing heat transferable dye, and a print head for selectively applying electrical energy to the contact surface of the ribbon, during sliding pressure contact and relative movement between the print head and ribbon in a movement direction, for selective resistive heating of the dye for transfer to a receiver underlying the ribbon remote from the ribbon contact surface and print head to form images on the receiver;

said print head comprising:

a row of side by side, spaced apart, selectively electrically energizable electrodes comprising electrically conductive, high hardness non-oxide ceramic material, and lying in an electrode plane extending crosswise of said movement direction and terminating in a corresponding row of exposed electrode end faces;

an electrically non-conductive substrate having a selective thermal conductivity comprising electrically non-conductive ceramic material; and an electrically non-conductive and thermally insulating barrier layer comprising electrically non-conductive ceramic material having a low thermal conductivity;

the row of electrodes in the electrode plane, the barrier layer and the substrate being in abutment, with the barrier layer interposed between the row of electrodes and the substrate for thermally separating the electrodes from the substrate, and with the row of electrode end faces lying in a contact plane for sliding pressure contact with said ribbon contact surface to apply electrical energy from the electrodes to the ribbon to heat said dye to a transfer temperature; and the barrier layer having a thermal conductivity at most about one-tenth of that of the substrate and a selective thickness sufficient to retard heat transfer from the electrodes to the substrate for controlling the temperature of the electrodes; and said ribbon comprising:

an upper electrically resistive base layer;

an intermediate electrically resistive ground layer; and a lower heat transferable dye bearing layer comprising dye heatable to a transfer temperature for transfer to a receiver;

the base layer defining said contact surface, and the base layer and ground layer serving to convert electrical energy applied by the electrodes to the ribbon to resistance heat for heating the dye in the dye bearing layer.

10. The combination of claim 9 wherein the substrate has a thermal conductivity of at least about 2 W/m.C., and the barrier layer has a thickness of about 1 to 50 microns.

11. The combination of claim 9 wherein the substrate has a thermal conductivity of about 2 to 260 W/m.C., and the barrier layer has a thermal conductivity of at most about one-tenth of that of the substrate and in the range of about 0.2 to 6 W/m.C. and a thickness of about 1 to 50 microns.

12. The combination of claim 9 further comprising a heat sink element connected to the substrate remote from the barrier layer and electrodes.

13. The combination of claim 9 wherein the contact plane extends at an acute angle to the electrode plane.

14. The combination of claim 9 wherein the row of electrodes in the electrode plane, the barrier layer and the substrate are in succession in said movement direction, the print head comprises a print head end portion, the substrate terminates in a substrate end face and the barrier layer terminates in a barrier layer end face, the electrode end faces, substrate end face, barrier layer end face and contact plane are located at the print head end portion, and the substrate end face and barrier layer end face are arranged in spaced relation to the contact plane and remote from the electrode end faces.

* * * * *